United States Patent [19]

Dykes

[11] 4,322,894

[45] Apr. 6, 1982

[54] SURFING FOOTWEAR

[76] Inventor: William E. Dykes, 23920 DeVille Way, Apt. D, Malibu, Calif. 90265

[21] Appl. No.: 141,325

[22] Filed: Apr. 18, 1980

[51] Int. Cl.[3] ..... A43B 5/08

[52] U.S. Cl. ..... 36/114; 36/8.1

[58] Field of Search ..... 36/8.1, 114, 59 R

[56] References Cited

U.S. PATENT DOCUMENTS

| | | | |
|---|---|---|---|
| 1,817,300 | 8/1931 | Dorogi et al. | 36/8.1 |
| 2,179,124 | 11/1939 | Jesnig | 36/8.1 |
| 3,605,292 | 9/1971 | Goldblatt | 36/8.1 |
| 3,676,940 | 7/1972 | Shively | 36/8.1 |

*Primary Examiner*—Patrick D. Lawson

[57] ABSTRACT

Novel surfing footwear is provided which comprises a foot covering in the form of a flexible boot or sandle, preferably open toed, or a thin elastic stocking, the bottom of which includes surf board traction improving means, such as spaced suction cups or the like, integral with the boot, sandle, or stocking, or individually or collectively releasably secured thereto. Preferably, the suction cups extend up around the heel and, in the case of the boot or sandle, may decrease in height from rear to front to permit the surfers' toes to contact the surfboard to "hang ten". The bottom portion of the boot or sandle may be thickened to stabilize the boot or sandle and to make the action of the suction cups more uniform. The footwear is light in weight, inexpensive, durable, and highly effective to increase traction of the surfers' foot on the surfboard for improved surfing.

2 Claims, 6 Drawing Figures

SURFING FOOTWEAR

BACKGROUND OF THE INVENTION

1. Field of the Invention

The present invention generally relates to surfing equipment and more particularly to novel footwear to increase the traction between the surfer's foot and the surfboard.

2. Prior Art

Surfers traditionally use surfboards having smooth, relatively long and flat upper surfaces which become very slick when wet by water. Besides having to balance against the surfboard and guide it as it tilts, plunges, lifts and changes direction during surfing, the surfer must also fight to keep from slipping around on and falling off of the slick wet board.

Such skills are not easily acquired. It would be desirable to be able to reduce the learning time for surfing and to render it safer and more attractive for a wider range of people of all age groups.

SUMMARY OF THE INVENTION

The foregoing needs are satisfied by the novel surfing footwear of the present invention. Such footwear is substantially as set forth in the abstract above. Thus, the novel footwear substantially increases traction between the surfer's foot and a wet slick surfboard during surfing to increase safety to the surfer and great control over the surfboard.

The footwear enables beginners of all ages to learn to surf more easily and surfers of all degrees of competence to improve their surfing skills.

The surfing footwear of the present invention can be in the form of a flexible boot, sandle, or sock. The bottom of the footwear is covered with integral or applied traction means such as gripping fingers, but preferably suction cups, which may extend around the heel and up above the bottom, particularly in the case of the sock so as to permit the sock to be misaligned on the foot and still provide superior traction.

In the case of the boot or sandle, the suction cups can decrease in height from rear to front of the footwear and the boot or sandle can decrease in height from rear to front of the footwear and the boot or sandle can be open toed to permit toe gripping of the surf board.

The bottom of the boot or sandle can be thickened to stabilize the boot and make the gripping action uniform. The footwear is inexpensive to make, durable, easy to use and effective. Further features are set forth in the following detailed description and accompanying drawings.

DRAWINGS

DETAILED DESCRIPTION

FIGS. 1–3

Figure 1:
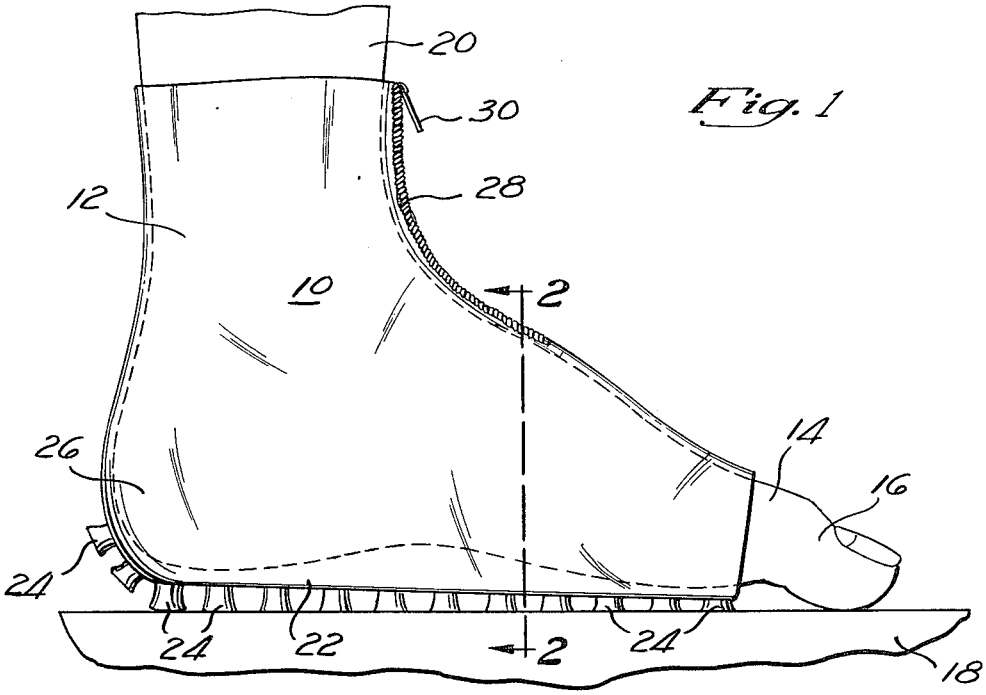
FIG. 1 is a schematic side elevation of a first preferred embodiment of the novel surfing footwear of the present invention, shown in boot form and being worn on a surfboard.
Figure 3:
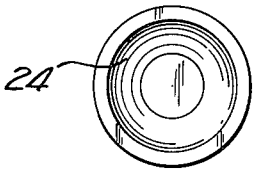
FIG. 3 is an enlarged schematic bottom plan view of one of the suction cups of FIGS. 1 and 2.
Figure 2:
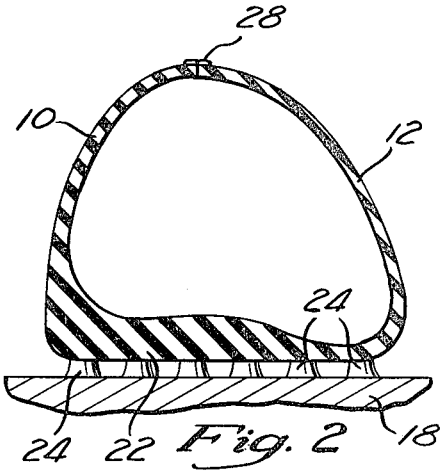
FIG. 2 is a schematic fragmentary cross section taken along the section line 2—2 of FIG. 1.

A first embodiment of the novel surfing footwear of the present invention is schematically depicted in FIGS. 1–3. Thus, boot 10 is shown which comprises a hollow covering or leading of flexible material which is preferably also elastic such as natural or synthetic rubber or rubber-like elastomers, such as polyurethane rubber, polysilicone rubber and the like. Covering 12 is adapted to fit around and receive a human foot 14 with the human toes 16 protruding forward of covering 12 (FIG. 1) so as to be able to better balance a sufer's foot 14 on a surfboard 18 during surfing.

Preferably, covering 12 extends up over the surfer's ankle (not shown) and lower leg 20 for added ankle and leg support. The bottom 22 of boot 10 is preferably relatively flat and is provided throughout with a plurality of spaced traction-increasing means in the form of depending suction cups 24 (FIGS. 1 and 2).

Each suction cup 24 can be of natural or synthetic rubber or the like elastic material and can be circular in outline or bell shaped (FIG. 3). Other forms of suction cups 24 can also be used.

Cups 24 are integral with boot 10 and can be for example, cast therewith by conventional thermoforming operations or the like. Cups 24 preferably run up above bottom 22 in the heel are 26 of boot 10 to permit the surfer to rock back on his heels and still have increased traction with surfboard 18.

Cups 24 preferably are graduated in size, decreasing in depth from the rear to the front of boot 10 so as to slightly cant foot 14 to enable toes 16 to touch the surfboard 18, even though bottom 22 is relatively thick. Such thickness is desired to stabilize boot 10 and equalize the traction provided by Cups 24.

Boot 10 may include closure means such as a zipper 28 and pull tab 30 running down the front of boot 10 to facilitate donning and removing of boot 10. Alternatively, a velcro fastening device can be used to secure the foot in the boot after insertion therein.

Boot 10 is well adapted to permit the surfer bearing one of the same on each of his or her feet to easily grip the wet upper surface of the surfboard 18 with cups 24 without slipping off or sliding around thereon. Thus, improved safety and control of the surfboard is provided.

FIG. 4

Figure 4:
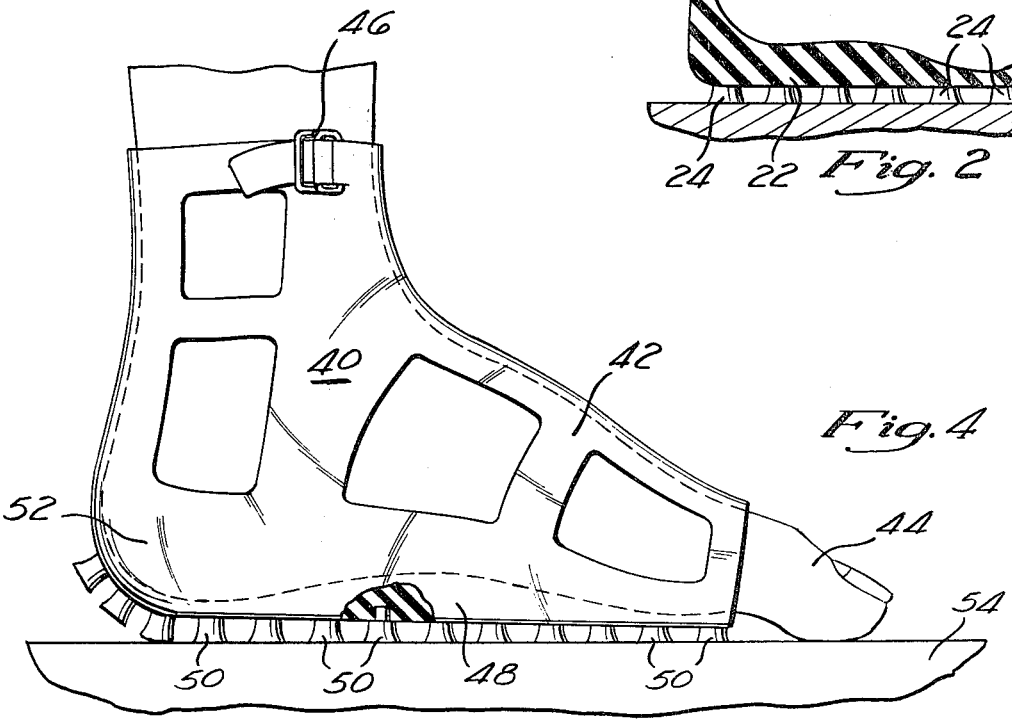
FIG. 4 is a schematic side elevation of a second preferred embodiment of the novel surfing footwear of the present invention, shown in sandle form and being worn on a surfboard.

A second preferred embodiment of the novel surfing footwear of the present invention is schematically depicted in FIG. 4. Thus, a sandle 40 is shown which comprises a covering 42 of flexible waterproof material, such as natural or synthetic rubber or the like. Covering 42 is open at the front to permit the surfer's toes 44 to stick through and may also be open at the sides thereof, but is releasably secured to the foot, as by a clasp 46 or hook and eye, or velcro fastener means (not shown) or the like at the upper end of sandle 40.

Sandle 40 has a thick bottom 48 bearing spaced, detachable, replaceable, depending suction cups 50, some of which are disposed in the heel area 52 of sandle 40. Cups 50 are preferably graduated in size, decreasing in depth from area 52 to the front of sandle 40.

Sandle 40 is light in weight and inexpensive, efficient and durable. Cups 50 easily grip surfboard 54 to increase traction therewith. Thus, sandle 40 has the advantage of boot 10.

FIG. 5

Figure 5:
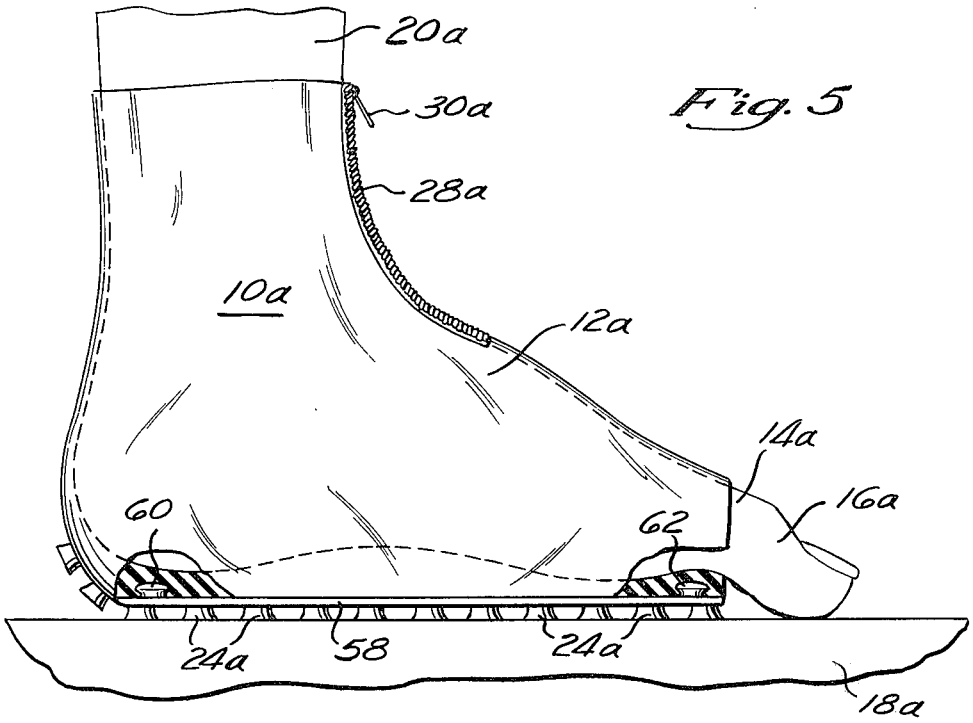
FIG. 5 is a schematic side elevation of a third preferred embodiment of the novel surfing footwear of the present invention, shown in boot form and being worn on a surfboard.

A third preferred embodiment of the novel surfing footwear of the present invention is schematically depicted in FIG. 5. Thus, boot 10*a* is shown which is similar to boot 10 and components of boot 10 which are similar to those of boot 10 bear the same numerals but are following by the letter "A".

Thus, boot 10*a* includes zipper 28*a* and pull tab 30*a* and suction cups 24*a*. Boot 10*a* is shown disposed on foot 14*a* and leg 20*a* with toes 16*a* exposed. Cups 24*a* are preferably of a single size and are connected to a flat plate 58 of hard rubber or the like, or if desired, a more pliable material which is in turn, releasably connected to the bottom 22*a* of covering 12*a* as by sets of snap buttons 60 and 62.

With this arrangement, plate 58 bearing cups 24*a* can easily be removed to permit walking in boot 10*a*. Moreover, plate 58 can be replaced by another plate (not shown) bearing larger or smaller suction cups or the like, as the occasion demands. Thus, boot 10*a* has the advantages of flexibility of use, as well as the advantages of boot 10.

FIG. 6

Figure 6:
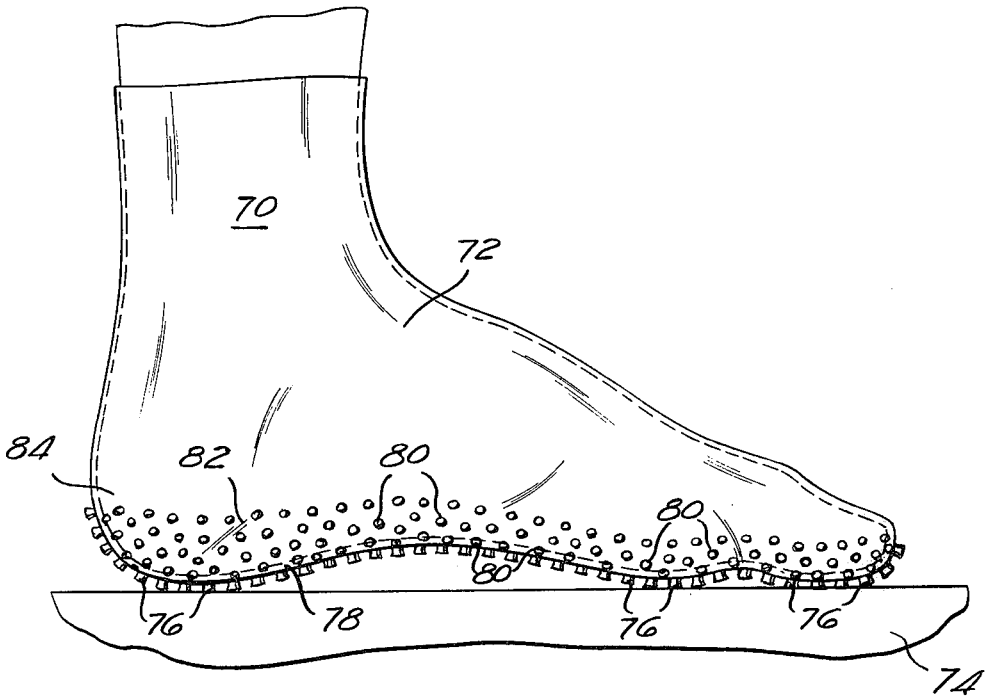
FIG. 6 is a schematic side elevation of a fourth preferred embodiment of the novel surfing footwear of the present invention, shown in sock or stocking form and being worn on a surfboard.

A fourth preferred embodiment of the novel surfing footwear of the present invention is schematically depicted in FIG. 6. Thus, sock 70 comprises a thin, very flexible and resilient preferably elastic covering 72 of, for example, natural or synthetic rubber, etc., which can be pulled on over the foot and as easily removed from the foot. Covering 72 permits a surfer's foot to freely flex and the surfer's toes to approximate the surfboard 74 and grip it.

Traction increasing means such as small suction cups 76 or the like are secured to the bottom 78 of sock 70 and may be integral therewith, if desired.

Cups 76 as well as supplemental gripping means in the form of tiny ridges, protrusions or fingers 88 or the like, can be spaced along the exterior of the bottom 78 and lower sides 82 and heel area 84 of covering 72 so that when sock 70 is pulled on the foot it can become somewhat misaligned with the foot and still provide improved traction on surfboard 74 even when sock 70 and surfboard 74 are both wet, as during surfing. Thus, sock 70 has substantially the advantage of boots 10 and 10*a* and sandle 40 and can be made inexpensively.

Various other modifications, changes, alterations, and additions can be made in the novel surfing footwear of the present invention, its components and their parameters. All such modifications, changes, alterations, and additions as are within the scope of the appended claims form part of the present invention.

What is claimed is:

1. Novel surfing footwear, said footwear comprising, in combination:

a. a flexible foot covering;

b. surfboard traction-improving means secured to the bottom exterior of said foot covering, c. wherein said traction-improving means comprises a plurality of suction cups spaced along said bottom, and d. wherein said suction cups which are adjacent the front of said foot covering are of decreased depth relative to others of said cups.

2. Novel surfing footwear, said footwear comprising, in combination:

a. a flexible foot covering;

b. surfboard traction-improving means secured to the bottom exterior of said foot covering, c. wherein said traction-improving means comprises a plurality of suction cups spaced along said bottom, and d. wherein said cups are disposed on a plate releasably secured to said bottom of said foot covering.

* * * * *